US005409056A

United States Patent [19]

Farry, Jr. et al.

[11] Patent Number: 5,409,056

[45] Date of Patent: Apr. 25, 1995

[54] U-FLOW TUBING FOR EVAPORATORS WITH BUMP ARRANGEMENT FOR OPTIMIZED FORCED CONVECTION HEAT EXCHANGE

[75] Inventors: James E. Farry, Jr., Williamsville; Don C. Corser; Elroy D. Powley, both of Lockport, N.Y.

[73] Assignee: General Motors Corporation, Detroit, Mich.

[21] Appl. No.: 882,181

[22] Filed: May 11, 1992

[51] Int. Cl.[6] ..... F28D 1/03

[52] U.S. Cl. ..... 165/153; 165/176

[58] Field of Search ..... 165/152, 153, 176

[56] References Cited

U.S. PATENT DOCUMENTS

| | | | |
|---|---|---|---|
| 4,800,954 | 1/1989 | Noguchi et al. | 165/153 |
| 4,915,163 | 4/1990 | Matsunaga | 165/153 |
| 5,062,477 | 11/1991 | Kadle | 165/152 |
| 5,101,891 | 4/1992 | Kadle | 165/153 |
| 5,111,877 | 5/1992 | Buchanan et al. | 165/153 |
| 5,111,878 | 5/1992 | Kadle | 165/153 |
| 5,125,453 | 6/1992 | Bertrand et al. | 165/153 |

*Primary Examiner*—John Rivell
*Assistant Examiner*—L. R. Leo
*Attorney, Agent, or Firm*—Patrick M. Griffin

[57] ABSTRACT

A multi tube evaporator with tubes having elongated side passages interconnected by an end crossover passage. The tube has oblong internal bumps in the side passages that have a low angle with the normal and partly spherical bumps in the crossover passage arranged so that heat transfer between the air passing past the tubes and the refrigerant passing through the tubes is by conduction through the walls of the tubes and the boundary layer of refrigerant moving along the inner walls of the tube and by forced convection of heat energy between the boundary layer and the main flow of refrigerant flowing therethrough. The low angle bumps in the side passages provide the least amount of drag of the refrigerant while effectively reducing the thickness of the boundary layer thereof to reduce its insular effect. The spherical bumps in the crossover are insensitive to the direction of flow and help provide a low pressure drop for effectively increasing efficiency of the evaporator.

3 Claims, 3 Drawing Sheets

U-FLOW TUBING FOR EVAPORATORS WITH BUMP ARRANGEMENT FOR OPTIMIZED FORCED CONVECTION HEAT EXCHANGE

BACKGROUND OF THE INVENTION

1. Field of the Invention

This invention relates to heat exchangers, and more particularly, to U-flow tubes for circulating heat exchanger fluids having specialized patterns of internal bumps in the side and crossover passages improving the flow of heat exchanger fluid through the tubes and heat exchanger operation while assuring the high strength brazing of plates together to form a tube.

2. Description of Related Art

In the heat exchanger disclosed in application U. S. Ser. No. 724,033, filed Jul. 1, 1991, now U.S. Pat. No. 5,111,878 for U-FLOW HEAT EXCHANGER TUBING WITH IMPROVED FLUID FLOW DISTRIBUTION, and assigned to the assignee of this invention, and hereby incorporated by reference, a multi tube heat evaporator for an air conditioning system is disclosed in which U-flow tubes with specialized internal bump patterns are employed to improve the flow of refrigerant through the tubes so that dry out areas that might otherwise occur in the tubes are eliminated or materially reduced and consequently the evaporator operates with higher efficiency.

SUMMARY OF THE INVENTION

This invention is of the general category of the tube construction of the above-identified patent, but further advances construction and heat transfer function of the tubes, and more particularly, relates to new and improved U-flow tubes for multi tube heat exchangers. Each tube has an elongated generally rectilinear member with pairs of tanks formed at one end thereof. A divider rib extends from a point between the tanks to a terminal end to define side-by-side internal flow passages with each passage having an array of crossed low-angle and oblong flow directing bumps that are interconnected by brazing to strengthen the tube. The side passages are connected by a crossover passage rounding the end of the divider rib which has partly spherical bumps therein that are not sensitive to flow direction and are accordingly effective for reducing pressure drop and improving heat transfer performance.

In evaporators with such tube construction, the refrigerant enters an inlet tank in a gas-liquid two phase flow and is distributed to each tube in the core. The refrigerant is mixed in the front staggered oblong bumped side passage of each tube, and gradually evaporates as it descends and makes the U-turn in the round bump crossover passage and then ascends through the back staggered oblong bump side passage until it enters another one of the tanks. This continues until the refrigerant exits from the evaporator as gas through an outlet pipe.

In this construction, the heat transfer phenomena occurring is controlled by the forced convection between the liquid refrigerant and the plates which form the U-flow tubes. The construction of this invention importantly creates and controls the thickness of a thin liquid film or boundary layer that flows as it spreads across the surfaces of the plates of the tubes. Since evaporation occurs between the liquid film and the vaporized portion of the refrigerant stream, the plate construction of the tubes of this invention improves forced convection properties. The side passages have an arrangement of staggered oblong bumps to obtain an optimized refrigerant turbulence and to control the thickness and thereby the heat insulation provided by the boundary layer dispersion of the refrigerant within each tube.

These oblong bumps form a low angle, such as seven degrees, with a normal parallel to the longitudinal axis of each plate. In addition to reducing boundary layer thickness, this bump inclination allows for any slight misalignment that might occur during plate manufacture with high speed multiple station progressive dies used to ensure the connection of the plate halves when a tube is formed from the plate halves. The low angle oblong bumps create turbulence without unduly adding to the pressure drop across the evaporator.

The round bumps in the U-turn area are not sensitive to flow direction but are effective in preventing liquid-vapor separation and are particularly effective in reducing refrigerant pressure drop throughout the core. These bumps guide the flow throughout the crossover passage while maintaining the effective turbulence. The combination of staggered oblong bumps in the straight sections and round bumps in the crossover section cooperate to provide low pressure drop and superior heat transfer performance for each tube.

The cup hole area in each tube also minimizes refrigerant pressure drop and ensures good plate-to-plate refrigerant distribution while maximizing the heat transfer effectiveness of the oblong bump section of the plate.

A small reduction in plate width at the cup section eliminates metal blank waste. To this end, the sides of the blank are drawn in when the cups are formed. This removes the need to shear a metal strip between adjacent blanks in the progressive die used to make the plate blanks. Only one shear cut is needed to divide one blank from the next so that there is no wasted blank strip. Economy of plate metal thickness is accomplished by matching cup design, bump shape, and bump spacing and bump brazing to meet burst strength required for high efficiency evaporators.

These and other objects, features and advantages of this invention will become more apparent from the following drawings and detailed description:

DESCRIPTION OF PREFERRED EMBODIMENTS

Figure 1:
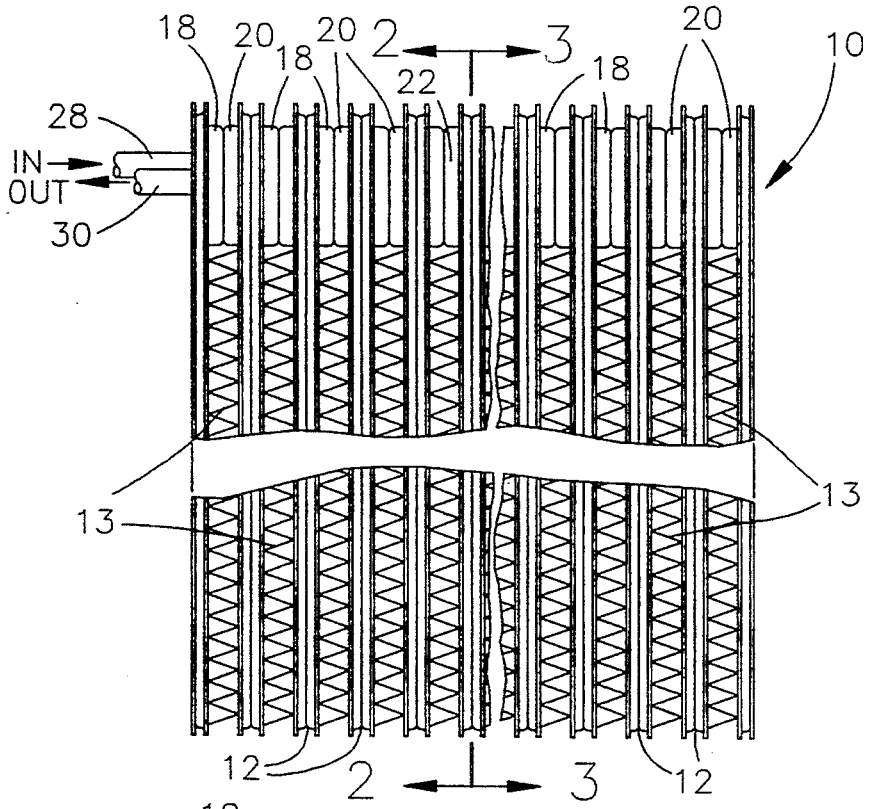
FIG. 1 is a front elevation view of an evaporator according to this invention.

Turning now in greater detail to the drawing, there is shown in FIG. 1 a heat exchanger 10 in the form of a multi-tube evaporator of an automotive air conditioning system adapted to be mounted within a module within the vehicle engine compartment and extending as outlets within the passenger compartment of a vehicle.

The heat exchanger comprises a core that has a plurality of generally flattened U-flow refrigerant transmitting tubes 12 generally similar to those of the above referenced patent that have corrugated air centers 13 therebetween. The tubes are formed from generally flat tube plates 14, 16, and FIGS. 2 and 3 that can be operatively interconnected with one another by projecting side-by-side drawn cups 18, 20 to provide laterally extending side-by-side tanks 22, 24 that are hydraulically connected by the U-flow paths 26 provided by the internal flattened body portion of the tubes 12.

Generally with this construction, refrigerant is introduced into one tank through an inlet pipe, such as pipe 28, and after coursing through the tubes and tanks in a predetermined path, such as disclosed in my application 07/902,161, now abandoned for U-CHANNEL EVAPORATOR HAVING ADJACENT FEED AND DISCHARGE PASSAGES AT ONE END, hereby incorporated by reference, is discharged through a final portion of the other tank through an exit pipe 30 connected therewith.

The refrigerant supplied to inlet pipe 28 from the condenser of the air conditioning system is in a liquid phase and the pressure of this refrigerant has been reduced by an orifice tube, not shown, in the line connecting the condenser to pipe 28. This lower pressure causes a flash evaporation of a portion of the liquid refrigerant. This process, in turn, causes a cooling of the low-pressure liquid vapor mixture. Generally, as the refrigerant courses through the passes of the evaporator, the liquid portion boils and vaporizes as it extracts heat energy from the air being supplied to the passenger compartment for passenger compartment cooling. After maximizing the change in phase from liquid to gas, the refrigerant is discharged through pipe 30 to an accumulator and compressor of the air conditioning system, not shown. As is known in this art, the compressor compresses the low pressure refrigerant vapor into a high pressure high temperature vapor for circulating in a condenser that condenses the vapor into a liquid phase for delivery back to the orifice tube and evaporator to complete a basic system.

Figure 2:
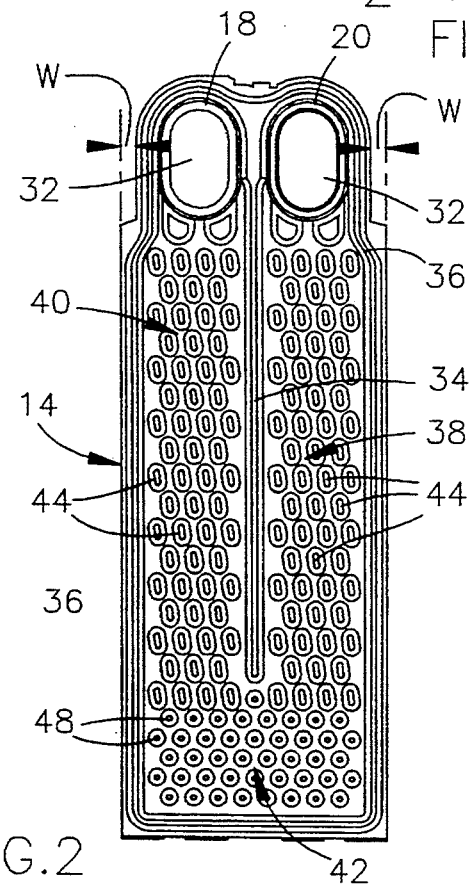
FIG. 2 is a view taken along sight line 2—2 of FIG. 1.
Figure 3:
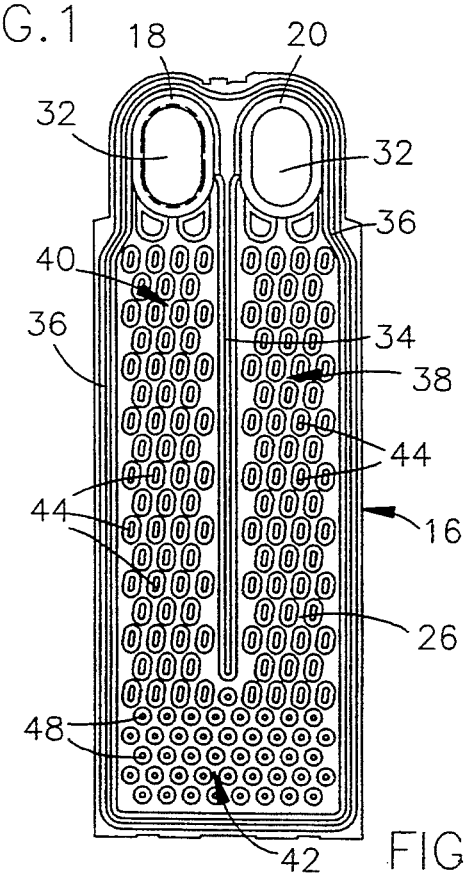
FIG. 3 is a view taken along sight line 3—3 of FIG. 1.

In the preferred embodiment, each tube is fabricated from the pair of plates 14, 16, shown in FIGS. 2 and 3 that are substantially identical and are referenced for description purpose as top plate 14 and bottom plate 16. Each plate is substantially a flat stamping except that the drawn cups 18, 20 at the upper end thereof protrude from the plane of the flattened body portion thereof. Each cup, 18, 20, is formed with a pair of holes or opening 32, as shown in FIGS. 2 and 3, with the exception of certain plates that may have a web in place of the opening to control the course of the refrigerant flowing through the core.

The area of the cup holes 32 in each tube also minimizes refrigerant pressure drop and ensures good plate-to-plate refrigerant distribution while maximizing the heat transfer effectiveness of the oblong bump section of the plate.

A small reduction in plate width W at the cups 18 and 20 eliminates metal blank waste. To this end, the sides of the blank are drawn in when the cups are formed. This removes the need to shear a metal strip between adjacent blanks in the progressive dies used to form the plates. Furthermore, only one shear cut is needed to divide one blank from the next resulting in no waste of material in the metal blank. Economy of plate metal thickness is accomplished by matching cup design, bump shape, bump spacing and bump brazing to meet burst strength required for high efficiency evaporators.

Figure 4:
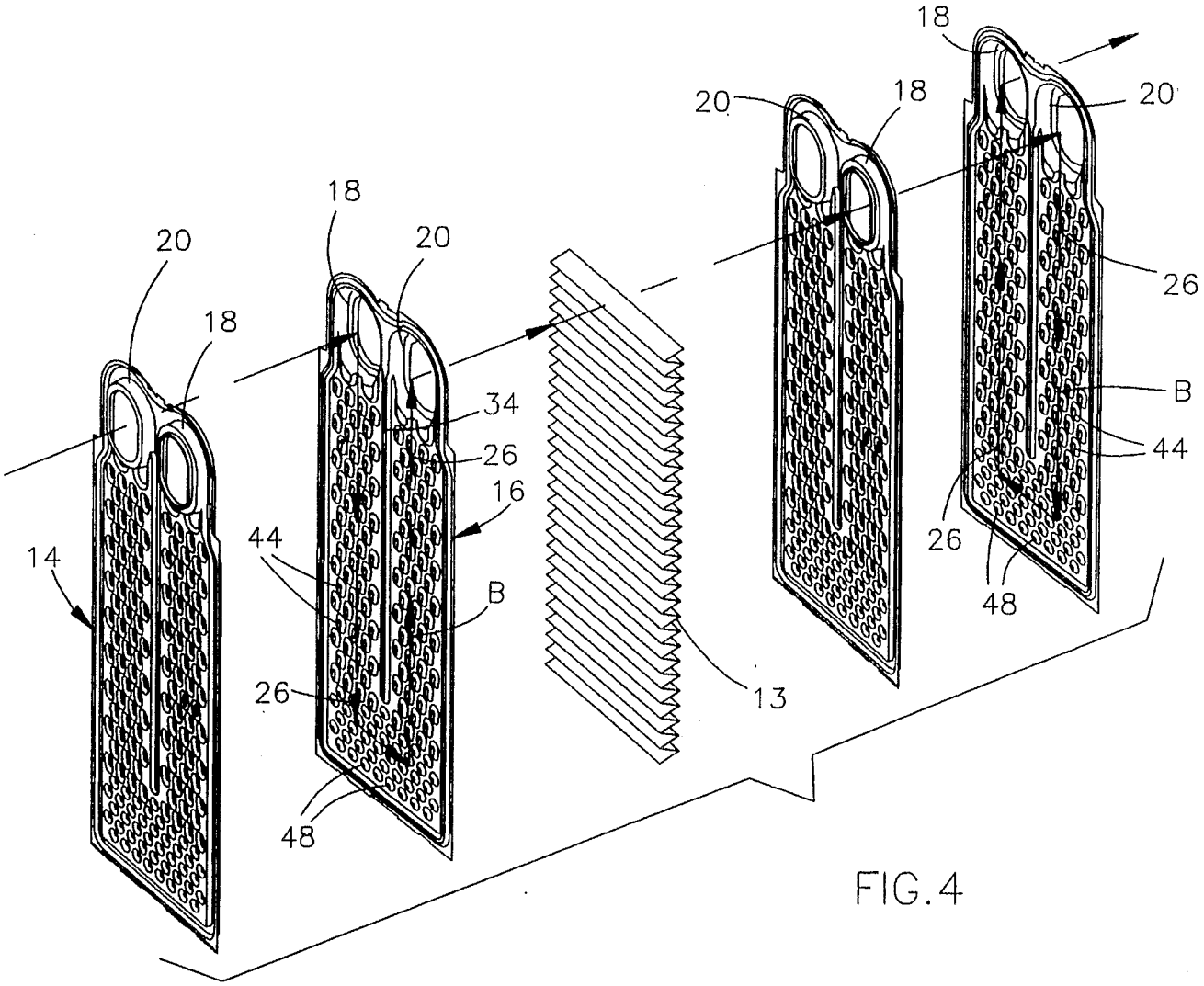
FIG. 4 is an exploded view of a pair of tubes formed by metal plates with a corrugated air center therebetween.
Figure 5:
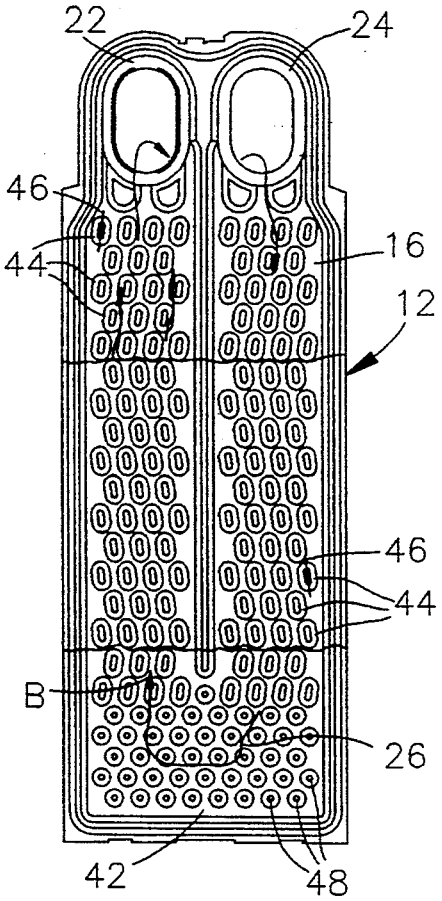
FIG. 5. is a elevational view of one of the tubes of the evaporator of FIG. 1 with parts broken away.

As shown in FIG. 2 and 3, each plate 14, 16 has an elongated centralized indented divider rib 34 which in conjunction with a closed wall 36 adjacent to the periphery of the plates defines side flow passages 38, 40 and cross over passage 42 at the bottom of the plate. These plates when interfaced and joined into tubes provide for the U-flow construction which has a predetermined pattern of oblong or generally elliptical indented bumps 44 in the side paths having major axes 46 formed at a low acute angle with respect to their normals, seven degrees for example. The tubes also have rounded bumps 48 that extend into the crossover passage. When the core plates are interfaced and brazed together, these bumps as well as the crossed elliptical bumps are brazed at their points of contact to provide optimized mechanical strength and to provide a turbulent and winding U-flow path, flow arrows B of FIGS. 4 and 5, through each tube, for effective transfer of heat energy between the heat exchanger fluid and the ambient air.

Figure 7:
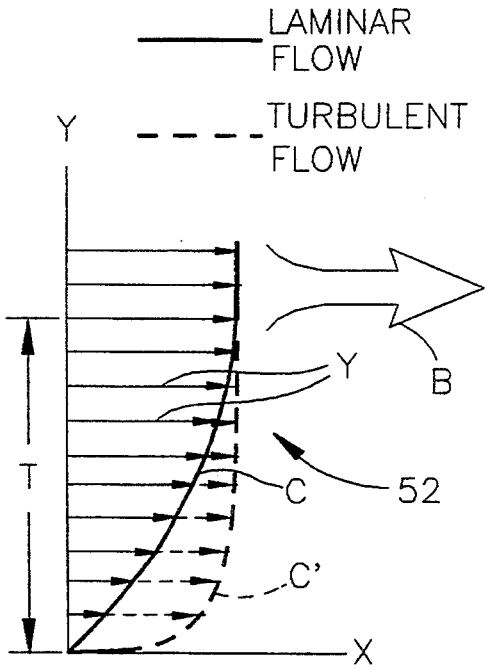
FIG. 7 is a diagram illustrating fluid velocity distribution in laminar and turbulent boundary layers of this invention.
Figure 6:
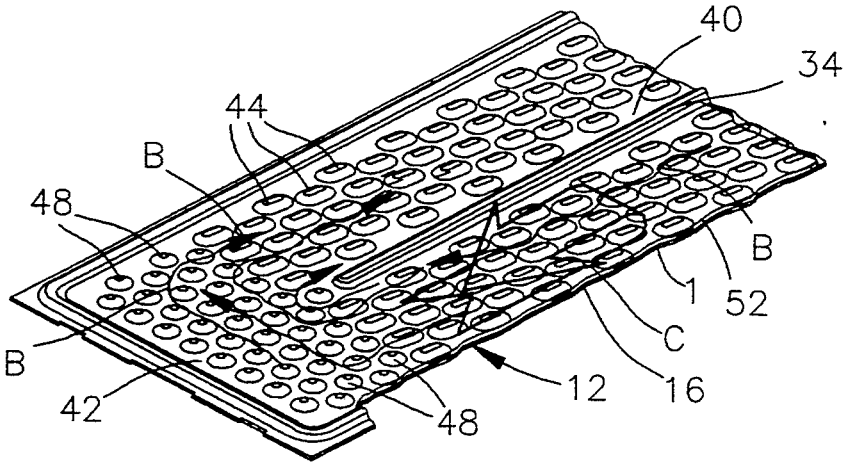
FIG. 6 is a diagrammatic pictorial view illustrating an operation or this invention.

As illustrated in FIGS. 6 and 7, each tube 12 has a boundary layer 52 of liquified refrigerant that may be turbulent or laminar and have a velocity distribution with minimized or substantially no slip at the interface of the plate and the boundary layer that progressively increases toward a maximum velocity in which the tangent to the curve C or C' in FIG. 7 is parallel to the Y axis of the curve. The thickness of the boundary layer 52 may vary in a range throughout the U-flow path through the tube and, while effectively eliminating dry out areas, may, if not controlled in thickness, act as an insulator to inhibit the transfer of heat energy from the air flowing past the tube to the main Flow B of the refrigerant coursing through the tube.

In the present invention, however, the low angled oblong bumps in the side passages are designed to allow the main flow B to control and effectively decrease the thickness of the boundary layer to thickness "T". This reduction occurs by the combining of the peripheral higher velocities at the outer limits of the boundary layer with the main flow of the refrigerant, as diagrammatically illustrated in FIG. 7. In any event, the boundary layer is reduced in thickness by these low angled bumps, and with this thickness reduction, there is improved heat transfer by conduction through the walls of the tube and the boundary layer 52.

As the refrigerant courses through the tubes, evaporation takes place between the upper surfaces of the boundary layer and the main vapor-liquid flow B, as illustrated by convection arrow C in FIG. 6. This occurs when the liquified fluid in the boundary layer in contact with the main flow gains energy and changes to vapor and rises to combine with the main flow.

While the above description constitutes preferred embodiments of the invention, it will be appreciated that the invention can be modified and varied without departing from the scope and fair meaning of the accompanying claims.

What is claimed is:

1. A U-flow tube for conducting vaporizable liquid heat exchanger fluid for use in a multi tube heat exchanger and having an air intake side and an air outlet side, said tube having an inlet and an outlet for said heat exchanger fluid;

said tube comprising first and second interfacing plates each having a longitudinal axis and an end;

each of said plates having a longitudinal rib starting from a point between said openings and extending to a terminus spaced from the end of said plate;

said rib defining said portions on either side thereof and a crossover between said side portions at the terminus of said rib;

said side portions having a pattern of oblong bumps defining an acute angle with respect to the longitudinal axis of said plate;

said crossover portion of each of said plates having a predetermined number of partly spherical bumps extending inwardly therein;

said tube as formed by the interfacing, connected plates so that said oblong bumps cross one another being effective to reduce the thickness of the boundary layer of the heat exchanger fluid circulating through said tube so that said heat energy is efficiently transferred by conduction through the material of the plate and the boundary layer to increase the rate of heat transfer by forced convection between the boundary layer and the refrigerant flowing through said tube.

2. A U-flow tube for conducting vaporizable liquid heat exchanger fluid for use in a multi tube heat exchanger and having an air intake side and an air outlet side, said tube having an inlet and an outlet for said heat exchanger fluid;

said tube comprising first and second interfacing plates each having a longitudinal axis and an end;

each of said plates being generally rectilinear and having side-by-side openings and having a longitudinal rib starting from a point between said openings and extending to a terminus spaced from the end of said plate;

said rib defining discrete side and a crossover between said side portions at the terminus of said rib;

said side portions having a pattern of oblong bumps thereon defining an acute angle with respect to the longitudinal axis of said plate;

said crossover portion of each of said plates having a predetermined number of partly spherical bumps extending inwardly therein;

said oblong bumps across one another when said tube is made and being effective to reduce the thickness of the boundary layer of the heat exchanger fluid circulating through said tube so that said heat energy is transferred by conduction through the material of the plate and the boundary layer for optimizing the transfer of heat energy by forced convection between the boundary layer and the main flow of liquid.

3. A U-flow tube for conducting vaporizable liquid heat exchanger fluid for use in a multi tube heat exchanger and having an air intake side and an air outlet side, said tube having an inlet and an outlet for said heat exchanger fluid;

said tube comprising first and second interfacing plates each having a longitudinal axis and an end;

each of said plates being a generally rectilinear member having side-by-side openings and having a longitudinal rib starting from a point between said openings and extending to a terminus spaced from the end of said plate;

said rib defining discrete side portions and a crossover between said side portions at the terminus of said rib;

said side portions having a plurality of oblong bumps defining an acute angle with respect to the longitudinal axis of said plate;

said crossover portion of each of said plates having a predetermined number of partly spherical bumps extending inwardly therein;

said tube as formed by the interfacing and connected plates being such that said oblong bumps cross one another to reduce the thickness of the boundary layer of the heat exchanger fluid circulating through said tube so that said heat energy is transferred by conduction through the material of the plate and the boundary layer to increase the rate of heat exchange by the forced convection of heat energy between the boundary layer and the main flow of liquid.

* * * * *